US005174605A

United States Patent [19]

Instance

[11] Patent Number: 5,174,605

[45] Date of Patent: Dec. 29, 1992

[54] LABELS AND MANUFACTURE THEREOF

[76] Inventor: David J. Instance, Guinea Hall, Sellindge, Kent TN25 6EG, United Kingdom

[21] Appl. No.: 684,946

[22] PCT Filed: Nov. 23, 1989

[86] PCT No.: PCT/GB89/01403

§ 371 Date: May 17, 1991

§ 102(e) Date: May 17, 1991

[87] PCT Pub. No.: WO90/05631

PCT Pub. Date: May 31, 1990

[30] Foreign Application Priority Data

Nov. 24, 1988 [GB] United Kingdom ..... 8827507

[51] Int. Cl.[5] ..... B42D 19/00

[52] U.S. Cl. ..... 281/5; 283/81; 283/101; 283/67; 428/42

[58] Field of Search ..... 281/5, 6, 7, 10, 11; 283/81, 94, 100, 101, 67; 428/40, 41, 42

[56] References Cited

FOREIGN PATENT DOCUMENTS 0018452 11/1980 European Pat. Off. .
0180365 5/1986 European Pat. Off. .
0192444 8/1986 European Pat. Off. .
0212919 3/1987 European Pat. Off. .
0232054 8/1987 European Pat. Off. .
0275525 7/1988 European Pat. Off. .

*Primary Examiner*—Timothy V. Eley
*Assistant Examiner*—Willmon Fridie, Jr.

[57] ABSTRACT

A self-adhesive label comprising a self-adhesive label base portion which is carried on a backing of release material, a printed region on the upper surface of the label base portion, and a sheet which is adhered to the label base portion adjacent the respective printed region and a cover which is adhered to the label base portion, the cover being openable to permit across to the sheet, the sheet and the cover being adhered to the label base portion by respective first and second portions of an adhesive layer which has been applied to the label base portion, the cover being not adhered directly to the sheet; and a method for producing one or more of such labels.

12 Claims, 1 Drawing Sheet

LABELS AND MANUFACTURE THEREOF

BACKGROUND OF THE INVENTION

The present invention relates to a method of producing labels and to a label.

It is known to produce so-called "extended text" labels which are self-adhesive and can be adhered to a product to be labelled, the extended text label including a portion which can be unfolded to reveal previously hidden surfaces which are provided with printed information relating to the product. In some applications, it is desirable to protect the label from soiling or damage by covering the label with a protective layer. However, the use of a protective layer can cause difficulties when the label is to be adhered to a non-planar surface e.g. a circular bottle. The problem encountered is that the resultant label is not sufficiently flexible to take up the contours of the surface to be labelled without being crumpled or stretched.

SUMMARY OF THE INVENTION

In one aspect, the present invention aims to overcome this technical problem.

The present invention provides a method of producing self-adhesive labels carried on a backing of release material, the method comprising the steps of:

(a) providing a self-adhesive elongate web which is carried on a backing of release material;

(b) printing a succession of printed images on the elongate web to provide a succession of printed regions;

(c) adhering a succession of sheets each to a respective area of the elongate web which is adjacent to a respective printed region;

(d) adhering a succession of covers to the elongate web, each cover being disposed over a respective adhered sheet; and (e) cutting at least through the elongate web as far as the backing thereby to provide a succession of self-adhesive labels, each including a respective portion of the elongate web having a respective printed region and adhered sheet and cover assembly, characterised in that the sheets and covers are adhered to the elongate web by adhesive which is applied to the surface of the elongate web, and in that the arrangement is such that each cover is not adhered directly to the respective sheet.

The adhesive may be a heat sealable adhesive or a water-soluble adhesive.

Preferably, the cover is dimensioned so that it covers a minority e.g. about one third of the area of the label.

In one preferred embodiment, the adhesive composition and the material of the cover are selected so that the cover can be pulled away from the elongate web thereby to permit access to the respective sheet.

In another preferred embodiment, the sheet is removably adhered to the elongate web and the cover can be torn open thereby to permit access to the respective sheet. Preferably, the sheet is removably adhered to the elongate web by one or more spots of adhesive. The cover may be provided with one or more weakened tear lines.

The sheet may be a folded sheet and may be composed of paper. The cover may be composed of paper or plastics.

The present invention also provides a self-adhesive label comprising a self-adhesive label base portion which is carried on a backing of release material, a printed region on the upper surface of the label base portion, a sheet which is adhered to the label base portion adjacent the respective printed region and a cover which is adhered to the label base portion, the cover being openable to permit access to the sheet, characterised in that the sheet and the cover are adhered to the label base portion by respective first and second portions of an adhesive layer which has been applied to the label base portion, and in that the cover is not adhered directly to the sheet.

In one preferred embodiment, the cover is removable from the label base portion thereby to permit access to the sheet.

In another preferred embodiment, the sheet is removably adhered to the label base portion and the cover can be torn open thereby to permit access to the sheet. Preferably, the sheet is removably adhered to the label base portion by one or more spots of adhesive. The cover may be provided with one or more weakened tear lines.

The sheet may be a folded sheet and may be composed of paper. The cover may be composed of paper or plastics.

Embodiments of the present invention will now be described by way of example only with reference to the accompanying drawings.

DETAILED DESCRIPTION OF THE PRESENTLY PREFERRED EMBODIMENTS

Figure 1:
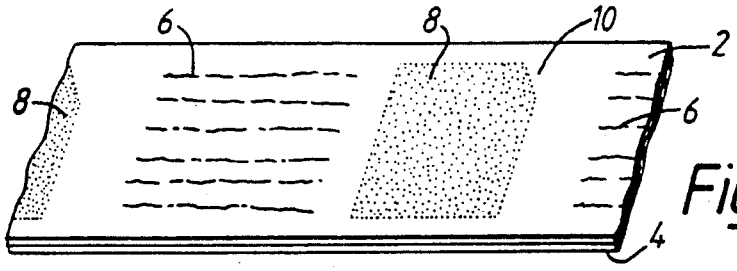
FIG. 1 is a perspective view of an elongate web of self-adhesive paper, carried on a backing of release material, which has had an adhesive applied to the upper surface thereof in accordance with a first embodiment of the present invention.

Referring to FIG. 1, there is shown an elongate web 2 of self-adhesive paper carried on a backing 4 of release material, such as waxed or polysiloxane-coated paper. The rear surface of the elongate web 2 is coated with a pressure-sensitive adhesive. The elongate web 2 is, in a later stage of the method of the present invention, die-cut in the manner described hereinbelow to form a succession of label base portions of respective self-adhesive labels which are releasably adhered to the backing 4. Accordingly, the elongate web 2 has a succession of printed regions 6, each of which printed regions 6 is intended to be disposed within a respective label base portion. Adjacent to each printed region 6 is applied an area 8 of adhesive. The adhesive may be a water-soluble adhesive such as as a PVA adhesive or a heat sealable compound. The adhesive may be applied to the upper surface of the elongate web 2 by printing e.g by means of a printing roller, in which case the adhesive area 8 is continuous, or by extrusion from an adhesive extrusion head, in which case the adhesive area 8 is in the form of a series of parallel beads. In the illustrated arrangement, the adhesive area 8 has been applied as a continuous layer. The adhesive area 8 is generally rectangular and is adjacent a respective region of printing 6, but one corner 10 of the rectangle is cut away so that the corner 10 of the rectangle is not provided with ahesive.

Figure 2:
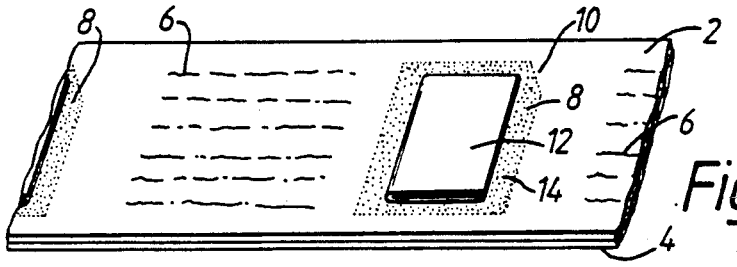
FIG. 2 is a perspective view of the web of FIG. 1 after a folded sheet has been applied to the adhesive.

As is shown in FIG. 2, a folded sheet 12 is applied to the adhesive area 8 so that the folded sheet 12 is surrounded by a border 14 of adhesive. The folded sheet 12 is, in the illustrated embodiment, a folded longitudinal strip which comprises a series of panels separated by a series of transverse fold lines. Each of the panels of the folded sheet 12, other than the face of the panel which is adhered to the elongate web 2 by the adhesive layer 8, may be provided with printed information.

Figure 3:
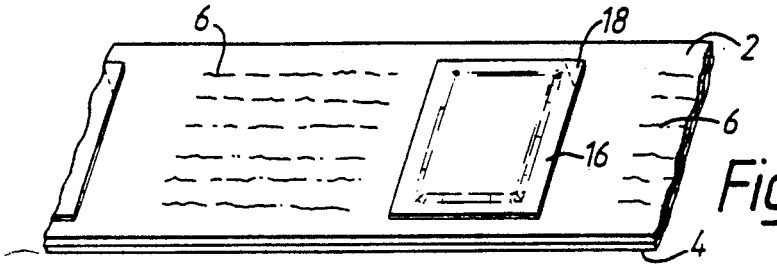
FIG. 3 is a perspective view of the web of FIG. 2 after a cover has been applied over the folded sheet.

Turning to FIG. 3, a cover 16 is adhered over each folded sheet 12 so as completely to enclose the respective folded sheet 12 between the cover 16 and the elongate web 2. The cover 16 is adhered to the elongate web 2 by the surrounding border 14 of the adhesive. The cover 16 may be composed of paper or of plastics material and the plastics material may be transparent. The cover 16 may be printed with information relating to the product to be labelled. The folded sheet 12 and the cover 16 may be applied to the elongate web 2 from respective stacks thereof in the manner which is disclosed in my earlier U.K. Patent No. 2127378 entitled "Method of Producing Labels". In the illustrated embodiment, the cover 16 is rectangular and is generally coincident with the adhesive layer 8 whereby a corner 18 of the cover 16 is situated above the corner 10 of the rectangle described above which is not coated with adhesive, so that the corner 18 is not adhered to the elongate web 2.

Figure 4:
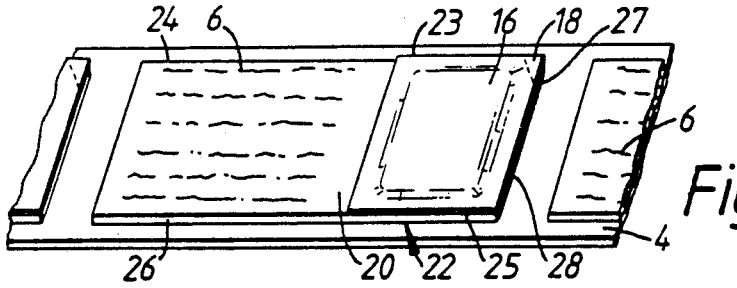
FIG. 4 is a perspective view of the assembly of FIG. 3 after a die-cutting step to form self-adhesive labels in accordance with the first embodiment of the present invention.

Referring to FIG. 4, the composite assembly of FIG. 3 is then die-cut e.g. by being passed through a pair of rollers composed of an upper die-cutting roller and a lower backing roller. The die-cutting step cuts out from the elongate web 2 a succession of label base portions 20, each of which includes a respective printed region 6 and a respective folded sheet 12/cover 16 assembly adhered thereto. The elongate web 2 is cut through completely but the backing 4 is not cut so that the resultant assembly, after the waste web remnant surrounding the label base portions 20 has been removed, is a series of self-adhesive labels 22 of the present invention carried in succession on the backing 4 of release material. In the cutting step, the upper and lower elongate longitudinal edges of the cover 16 are also trimmed away and are removed together with the waste web remnant so that in the resultant self-adhesive label 22 the upper and lower edges 23, 25 of the cover 16 coincide with the upper and lower edges 24, 26 of the label base portion 20. In addition, a transverse edge 27 of the cover 16 is also cut so as to be coincident with the corresponding transverse edge 28 of the label base portion 20.

Figure 5:
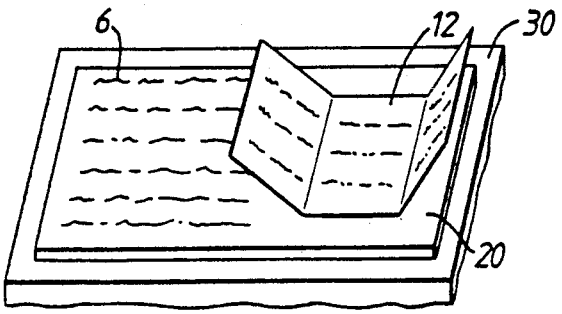
FIG. 5 is a perspective view of the self-adhesive label of the first embodiment after the cover has been removed and the folded sheet has been opened, the self-adhesive label being adhered to a product.

The resultant self-adhesive label 22 can be stripped off from the backing 4 of release material and adhered, by its self-adhesive surface on the rear face of the label base portion 20, to a product 30 to be labelled, as shown in FIG. 5. The cover 16 can be pulled away from the label base portion 20 thereby to reveal the folded sheet 12 by manual gripping and pulling of the un-adhered corner 18 of the cover 16. Once the cover 16 has been pulled away, the folded sheet 12 can be unfolded and read by a user in the manner shown in FIG. 5. The material of the cover 16 and the type of adhesive for the adhesive layer 8 may be selected so that either the cover 16 strips off the overlapping border 14 of adhesive from the label base portion 20 or the cover 16 is stripped off free of adhesive so that the adhesive border 14 remains on the label base portion 20.

Figure 6:
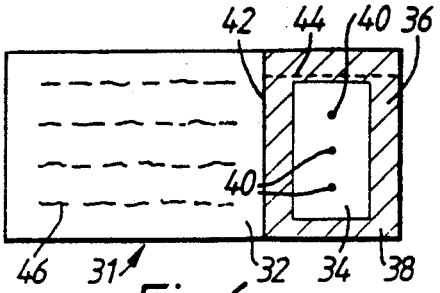
FIG. 6 is a plan view of a self-adhesive label in accordance with a second embodiment of the present invention.

FIG. 6 shows a further embodiment of the present invention and is a plan view of a self-adhesive label 31. The self-adhesive label 31 includes a label base portion 32 similar to that of the first embodiment. In the second embodiment, a sheet 34 which is adhered between the label base portion 32 and a cover 36 may be either a single sheet or a folded sheet such as that used in the first embodiment. Alternatively, the sheet 34 may have any other suitable folded configuration. For the sake of clarity, in FIG. 6 the cover 36 is composed of transparent plastics so that the sheet 34 can be seen therethrough. In addition, the adhesive area 38 (which is not actually shown in FIG. 6 but the position of which is represented by the hatched area) does not consist of a single region of adhesive but rather it consists of a few isolated spots 40 of adhesive which are surrounded by an outer border 42 of adhesive, which may be a continuous layer or formed from a series of adhesive beads. The sheet 34 is applied over the spots 40 of adhesive which act temporarily to adhere the sheet 34 to the elongate web before the cover 36 is adhered thereover. The cover 36 is adhered to the adhesive border 42 which surrounds the applied sheet 34. The cover 36 is provided with a line of perforations 44 or, alternatively, a double tear line to define a tear-off strip of the cover 36. A printing region 46 is provided adjacent the cover 36.

In use, the label base portion 32 is adhered to a product. When it is desired to access the applied sheet 34, the line of perforations 44 is torn and it is thus possible for the applied sheet 34 to be manually gripped through the torn edges of the cover 36. Since the spots 40 of adhesive are small in area the applied sheet 34 can easily be separated and pulled away from the label base portion 32 and out from between the cover 36 and the label base portion 32 without damaging the sheet 34. The sheet 34 can then be read by user and if desired be inserted back between the cover 36 and the label base portion 32. The spots 40 of adhesive are employed merely to hold the applied sheet 34 in position on the web during the manufacturing process before the cover 36 is adhered thereover thereby sealing the sheet 34 between the cover 36 and the label base portion 32. If spots 40 of adhesive were not used, the applied sheet 34 could slip out of position on the elongate web prior to the application of the cover 36.

In each of the foregoing embodiments, it should be understood that it is possible to use a heat-sealable compound instead of an adhesive for the adhesive area 8 or 38. The applied sheet and the cover could therefore be adhered to the label base portion by heat sealing by means of applying heat to the heat sealable compound.

The present invention provides a specific advantage over known labels in that it enables a self-adhesive label, having an extended text portion which is protected against damage or soiling by a cover adhered thereover, to be wrapped around a bottle without any crumpling or stretching of the label This advantage particularly is achieved with relatively long labels which are e.g. 25 cm long. Since the cover is relatively short e.g. one third of the total length of the label, the crumpling problem is avoided because the label does not have an extensive length of a cover/label base portion interface. Such an interface is difficult to subject to bending without crumpling of the layers since the inner layer will be bent around a smaller radius than the outer layer. Since the inner layer is of paper, this difference in radius causes the paper to crumple. Accordingly, since the present label has only a short interface length the crumpling problem can be obviated.

I claim:

1. A method of producing self-adhesive labels carried on a backing of release material comprising the steps of:

(a) providing a self-adhesive elongate web which is carried on a backing of release material;

(b) printing a succession of printed images on the elongate web to provide a succession of printed regions;

(c) adhering with adhesive a succession of sheets to respective areas of the elongate web, each sheet being positioned adjacent to a respective printed region;

(d) adhering with adhesive a succession of covers to the elongate web, each cover being disposed over a respective adhered sheet but not directly adhered thereto; and (e) cutting at least through the elongate web as far as the backing thereby to provide a succession of self-adhesive labels, each label including a respective portion of the elongate web having a respective printed region and adhered sheet and cover assembly.

2. The method according to claim 1 wherein the covers are selected to cooperate such that each cover can be pulled away form the elongate web thereby to permit access to the respective sheet.

3. The method according to claim 1 wherein each sheet is removably adhered to the elongate web and each cover can be torn open thereby to permit access to the respective sheet.

4. The method according to claim 1 wherein each sheet is removably adhered to the elongate web by one or more spots of adhesive.

5. A self-adhesive label comprising a self-adhesive label base portion which is carried on a backing of release material, a printed region on an upper surface of the label base portion, a sheet which is adhered to the upper surface of the label base portion and adjacent to the printed region and a cover which covers the sheet and is adhered to the label base portion, the cover being openable to permit access to the sheet, the sheet and the cover being adhered to the label base portion by respective first and second portions of an adhesive layer applied to the label base portion, the cover being not adhered directly to the sheet.

6. The label according to claim 5 wherein the cover is removable form the label base portion whereby to permit access to the sheet.

7. The label according to claim 5 wherein the sheet is removably adhered to the label base portion and the cover can be torn open thereby to permit access to the sheet.

8. The label according to claim 6 wherein the sheet is removably adhered to the label base portion by one or more spots of adhesive.

9. The method according to claim 2, wherein each sheet is removably adhered to the elongate web and each cover can be torn open thereby to permit access to the respective sheet.

10. The method according to claim 2, wherein each sheet is removably adhered to the elongate web by one or more spots of adhesive.

11. The label according to claim 6, wherein the sheet is removably adhered to the label base portion and the cover can be torn open thereby to permit access to the sheet.

12. The label according to claim 7, wherein the sheet is removably adhered to the label base portion by one or more spots of adhesive.

* * * * *